United States Patent [19]

Swingler

[11] 4,188,560

[45] Feb. 12, 1980

[54] FLANGED CYLINDRICAL ELECTRON MULTIPLIERS

[75] Inventor: Donald L. Swingler, Park Orchards, Australia

[73] Assignee: Commonwealth Scientific and Industrial Research Organization, Campbell, Australia

[21] Appl. No.: 936,911

[22] Filed: Aug. 25, 1978

[30] Foreign Application Priority Data

Aug. 24, 1977 [AU] Australia ..... 1373/77

[51] Int. Cl.[2] ..... H01J 43/10

[52] U.S. Cl. ..... 313/105 R; 328/243

[58] Field of Search ..... 313/105 R, 104

[56] References Cited

U.S. PATENT DOCUMENTS 2,159,519 5/1939 Brauer et al. ..... 313/105 X

*Primary Examiner*—Robert Segal

[57] ABSTRACT

Electron Multiplier in which the charge current is conformed by an electrostatic field to pass in alternating fashion between successive dynode surfaces of two opposed rows, the dynodes of one row being on outer surfaces of coaxial cylindrical elements and the dynodes of the other row being on inner surfaces of surrounding annular elements.

24 Claims, 5 Drawing Figures

FLANGED CYLINDRICAL ELECTRON MULTIPLIERS

This invention relates to electron multipliers of the kind in which, in use of the multiplier, a charge current is amplified by passage to, and by secondary emission of electrons from, surfaces of successive dynodes of a dynode array, there being two generally parallel rows of said dynodes, the dynodes in each row being in side-by-side position, said successive dynodes being dynodes in alternate ones of said rows and succeeding adjacent ones of the dynodes in each row receiving said charge current in use of the multiplier; said dynodes being shaped such that electric potentials which are in use applied to the dynodes generate, an electric field between the two rows such as to effect substantial direction of secondary electrons produced at said surface to the surface of the next successive dynode. Such an electron multiplier is hereinafter referred to as "an electron multiplier of the kind described". These electron multipliers are commonly referred to as "focussed" electron multipliers.

According to the present invention there is provided an electron multiplier of the kind described wherein the surfaces of dynodes in one said row are substantially cylindrical in configuration on a common axis, dynodes of the one row being spaced along said axis, the surfaces of dynodes of the other said row also being substantially cylindrical in form coaxial with surfaces of dynodes of the first row the said surfaces of the dynodes of the other said row being of greater diameter than those of dynodes of the first row and dynodes of the said other row being spaced lengthwise along the said axis, the surfaces of the dynodes of said one row facing away from said axis and the surfaces of dynodes of the other row facing towards said axis in opposed relationship to the surfaces of the dynodes of said one row.

In a preferred construction, said surface of each dynode is linear when viewed in axial section with first and second flanges positioned along edges of the surface to opposite axial ends thereof said firt flange extending substantially normally to the surface from one said opposite edge and said second flange having a first portion extending substantially normally to the surface from the other opposed edge in the same direction as said one flange and to a second portion extending from an outer longitudinal edge of the first portion parallel to said surface and directed in the direction away from the first flange. Said second portion of each said second flange may be positioned further from said surface than the free edge of the first flange. The proportions of the dynodes may be substantially as follows, where

- a is the distance between flanges of a said dynode,
- a' is the width (measured in the axial direction of the multiplier) of said second portion of said second flange of a said dynode,
- $b'_i$ and $b'_o$ are the heights above said surfaces of said first flanges of dynodes of said one row and of said other row respectively,
- $b_i$ and $b_o$ are the heights above said surfaces of said first portions of said second flanges of dynodes of said one row and of said other row respectively, and
- $r_i$ and $r_o$ are the radii of said surfaces of dynodes of said one row and of said other row respectively, for a defined within the range $r_i \leqq a \leqq 2r_i$

| | | | | | |
|---|---|---|---|---|---|
| $a'$ | = | $0.3\ a$ | | | |
| $b_i$ | = | $0.15\ r_i$ | $b_o$ | = | $0.15\ r_o$ |
| $b_i'$ | = | $0.5\ b_i$ | $b_o'$ | = | $0.5\ b_o$ |
| $r_o$ | = | $r_i + 1.2\ a$ | | | |

These relations can be alternatively expressed, less generally, as follows, the constants indicated being those prevailing where the variables are expressed in mm:

| | | | | | |
|---|---|---|---|---|---|
| $a$ | = | $r_i$ | | | |
| $a'$ | = | $0.3\ a$ | | | |
| $b_i$ | = | $0.45\sqrt{r_i}$ | $b_o$ | = | $0.45\sqrt{r_o}$ |
| $b'_i$ | = | $0.5\ b_i$ | $b'_o$ | = | $0.5\ b_o$ |
| $r_o$ | = | $2.1\ r_i$ | | | |

The invention also provides a dynode array for an electron multiplier of the kind described and comprising two said rows each of at least two said dynodes, dynodes in one row having said surfaces there in opposed facing disposition relative to said surfaces of dynodes of the other row, the said surface of each said dynode in each said row, which surface is adjacent an edge of a surface of an adjacent succeeding said dynode, being bounded by a first flange extending normally of the surface and towards the other row, and the said surface of each respective succeeding dynode in a row being bounded at an edge adjacent the said first flange of the respective adjacent preceding dynode in its row by a second flange having a first portion extending normally of that said surface towards the other row and parallel to but spaced from the first flange of the respective said preceding dynode and a second portion extending outwardly from a lengthwise free edge of the first portion, which free edge is closest the other row and parallel to the said surface of its dynode, and over and spaced from the free edge of the first flange of the respective preceding dynode; wherein said surfaces of dynodes in said one row are substantially cylindrical in configuration, with axes aligned on a common axis, said surfaces of dynodes of said other row also being substantially cylindrical in form with axes coaxial with said common axis, the surfaces of dynodes of the other row being of greater diameter than those of dynodes of said one row. The second portion of each said second flange may extend to overlie in spaced disposition a marginal part of the said surface of the respective preceding dynode, which marginal part is adjacent to and extends along said first flange of the respective preceding dynode. The overlap of each said second portion over the surface of the respective preceding dynode may be by an amount of approximately 25% of the width of such second portion. Alternatively, the second portion of each second flange may extend only to a location substantially directly above the first flange of the respective preceding dynode.

The arrangement is normally such that dynodes in each said row are spaced apart a constant pitch, but dynodes in one row are shifted by a distance equal to half of the pitch in the direction of extent thereof, relative to the other row.

The dynode array may include additional deflecting surfaces arranged at input and output ends of the array to direct current in and out of the array. These surfaces may be but are not necessarily dynode surfaces.

The invention also provides an electron multiplier of the kind described including an array as described in the preceding paragraph, with the said second portions of said second flanges directed, from said first portions, in the direction towards the input end of the multiplier, means being provided for applying electric potentials across each successive pair of electrodes to generate the said field. The multiplier may include grid means for acceleration of charged particles towards the first dynode thereof, whereby the multiplier may be used for detecting output current from mass spectrometer.

In a particularly preferred form of the invention, the said surfaces of dynodes of the said one row are surfaces of secondary emission elements removably secured to structure defining the remainder of these dynodes. Such structure may comprise a series of cylindrical elements, each defining the flanges of a separate said dynode, to opposed edges thereof, with the secondary emission elements being in the form of respective flexible strips, each extending around a said cylindrical element between the said flanges of that element. Similarly, the surfaces of dynodes of said other row may be removably carried by supporting structure defining the remainder of the dynodes. In a preferred form, the last mentioned structure comprises a series of annular elements, each element carrying the said flanges of a said dynode to opposed edges thereof and with the said surfaces defined on secondary emission elements, the said secondary emission elements, these secondary emission elements being in the form of flexible strips removably secured to the respective inside surfaces of the annular elements, between the said flanges thereof. The said cylindrical elements of said one row are preferably formed of conductive material and mechanically secured together, but electrically insulated from each other. Similarly, the said annular elements of said other row are preferably formed of conductive material and are mechanically secured together but electrically insulated from each other.

The invention further provides a dynode for an electron multiplier characterized in that the secondary emission surface thereof is removable from a supporting element defining the remainder of the dynode. Thus, the surface may be formed on an element removable from the said supporting element or may be a deposit on such an element. In particular, it could be formed by evaporation sputtering, plasma spraying, electro plating, or other chemically reactive gaseous or liquid process, such as electro deposition, or electrolytic processes such as electro plating followed by caesiation or other treatment to render the surface a high yielding secondary electron emitting surface.

The invention is further described with reference to the accompanying drawings in which.

Figure 1:
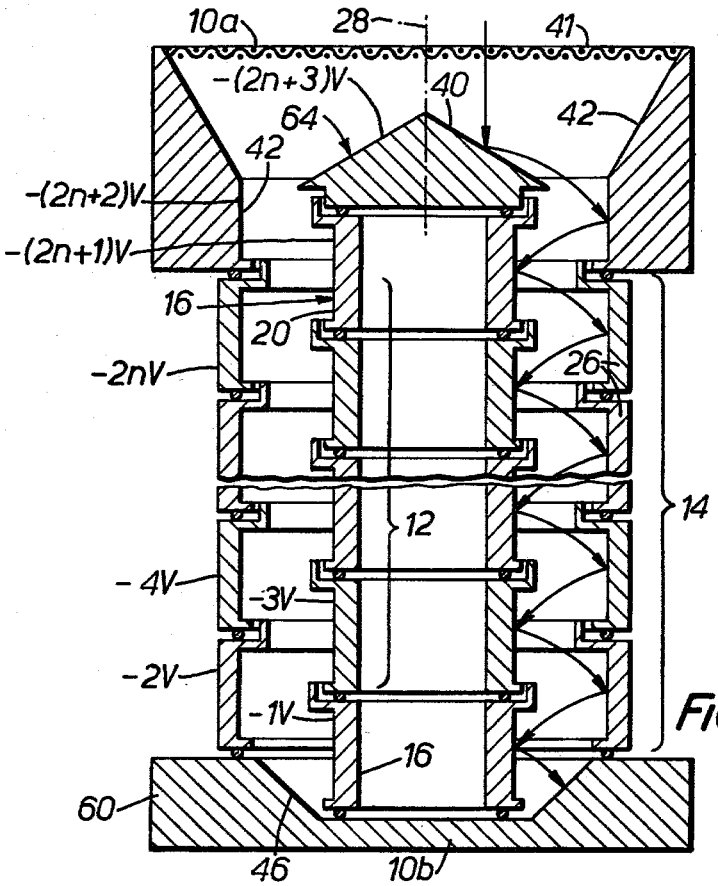
FIG. 1 is a diagrammatic axial cross-section of an electron multiplier constructed in accordance with the invention.
Figure 2:
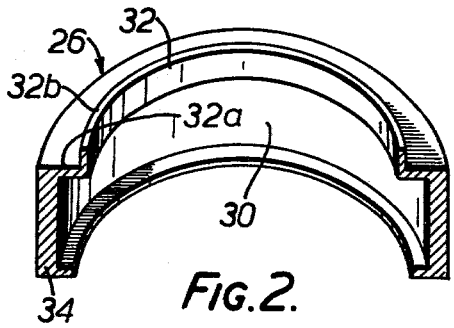
FIGS. 2 and 3 are, respectively, axially sectioned perspective views of two forms of dynode incorporated into the multiplier of FIG. 1.
Figure 3:
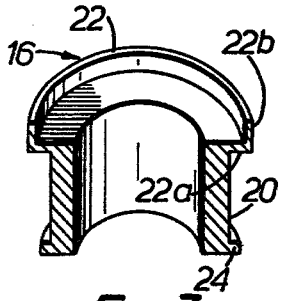

The electron multiplier 10 shown comprises an inner row 12 of dynodes 16 and an outer row 14 of dynodes 26. The dynodes 16 of row 12 each present a separate outer cylindrical surface 20 coated with or formed from a material which will generate secondary electrons when struck by primary charged particles. The dynodes are spaced along a common axis 28. Each dynode 16 has, at the opposed axial end edges of its surface 20, respective outstanding annular flanges 22, 24. The flange 24 of each dynode 16 extends at right angles to the associated surface 20 of that dynode. Each flange 22 has a first portion **22*a* which likewise extends at right angles to its associated surface 20, but to a greater distance away from that surface than the flange 24, and a second portion 22*b* which extends, from the outer margin of portion 22*a* parallel to surface 20 and away from flange portion 22*a* in a direction opposite to the direction of extent of the associated surface 20 from flange portion 22*a***.

Row 14 includes a plurality of dynodes 26 arranged in spaced relationship coaxial with the common axis 28 of row 12. Dynodes 26 each present separate inwardly facing cylindrical surfaces 30 coaxial with axis 28 and spaced outwardly of the surfaces 20. Annular flanges 32, 34 are arranged at opposed axial ends of each surface 30. Each flange 34 extends normally to surface 30 of its dynode and inwardly towards axis 12 a short distance. Each flange 32 has a first portion **32*a* which also extends normally to surface 30 of its dynode and inwardly toward axis 28 together with a second portion 32*b* which extends parallel to the surface 30 of its dynode but which is directed away from its associated portion 32*a* in the direction opposite to the direction in which surface 30 of that dynode extends away from that flange portion 32*a***.

The dynodes 16, 26 at an input end **10*a* of the multiplier are adjacent the respective input surfaces 40, 42. Surface 40 is of conical form being coaxial with axis 28 and with its apex facing outwardly of the multiplier. Surface 40 is a dynode surface positioned to receive electrons or other charged particles passing into the input end of the multiplier first on to the surface 42 and to generate secondary electrons for passage into the array comprised of dynodes 26 and 16. Surface 42 is of annular form, like surfaces 30, and serves as a dynode surface. It is carried by an end piece 62** described later.

A mesh grid 40 is positioned over the input end of the multiplier to prevent electrons or other charged particles from leaving the multiplier.

Figure 4:
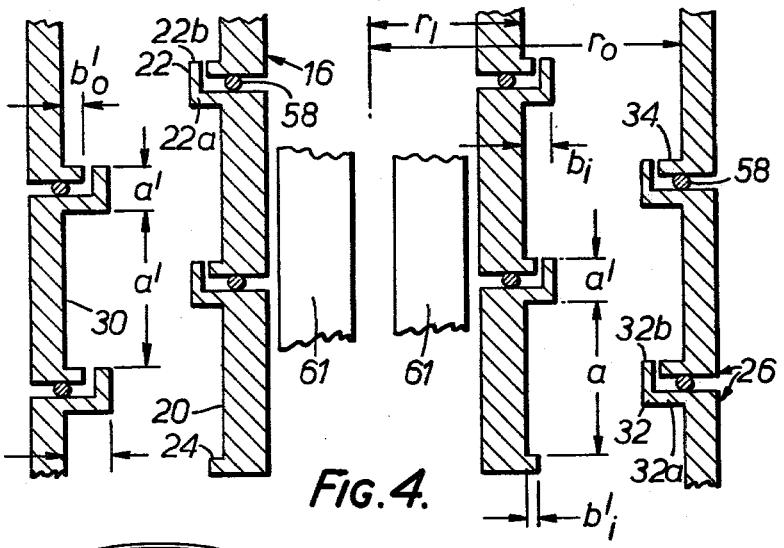
FIG. 4 is an enlarged diagram, being an axial cross-section of part of the multiplier of FIG. 2.

Referring now particularly to FIG. 4, the arrangement of the dynodes subsequent to that provided by surface 40 is such that flange 42 of each except the last dynode 26 in row 14 is adjacent the flange of the preceding dynode, but spaced therefrom. The dimension $b_o$ being the height to which flange portions **32*a* of flanges 32 project from each surface 30, is chosen to be greater than the height $b'_o$ to which flanges 34 project from surfaces 30. In an analogous manner, the dynodes 16 of row 12, except for the last dynode, have flanges 22 adjacent the flange 24 of the preceding dynode, but spaced therefrom. The dimension $b_i$, being the height to which flange portions 22*a* of flanges 22 project from surface 20, is arranged to be greater than the height $b'_i$ to which flanges 24 project from surfaces 20. The width of the flange portions 22*b*, measured in the axial direction of the multiplier and the width of the flange portions 32*b*, measured in the axial direction of the multiplier, are each designated a'. The surfaces 30 are of radius $r_o$ and surfaces 20** are of radius $r_i$. It is preferred that the following relationships obtain between these defined measurements:

for a defined within the range $r_i \leqq a \leqq 2r_i$

| | | | | | |
|---|---|---|---|---|---|
| $a'$ | = | $0.3\ a$ | | | |
| $b_i$ | = | $0.15\ r_i$ | $b_o$ | = | $0.15\ r_o$ |
| $b_i'$ | = | $0.5\ b_i$ | $b_o'$ | = | $0.5\ b_o$ |
| $r_o$ | = | $r_i + 1.2\ a$ | | | |

These relations can be alternatively expressed, less generally, as follows, the constants indicated being those prevailing where the variables are expressed in mm:

| | | | | | |
|---|---|---|---|---|---|
| $a$ | = | $r_i$ | | | |
| $a'$ | = | $0.3\ a$ | | | |
| $b_i$ | = | $0.45\ \sqrt{r_i}$ | $b_o$ | = | $0.45\ \sqrt{r_o}$ |
| $b'_i$ | = | $0.5\ b_i$ | $b'_o$ | = | $0.5\ b_o$ |
| $r_o$ | = | $2.1\ r_i$ | | | |

The measurement "a" refers to the width of the dynode surfaces 20, 30, in the axial direction.

At the output end **10*b* of the multiplier there is provided a collector surface 46. This is of annular dished form and is positioned to receive secondary electrons emitted from the surface 20 of the last dynode 16 in row 12**.

In use of the multiplier 10 the successive dynodes 16 in row 12 counting from the output end **10*b* of the multiplier are supplied with voltages of magnitudes $-1V$, $-3V \ldots -(2n-1)V$ and the dynodes 26 are provided, in succession counting from the output end 10*b* with voltages $-2V$, $-4V \ldots -2nV$, where V is a substantial voltage of the order normally employed with linear array multipliers. Collector surface 46 is effectively at zero voltage by virtue of connection to a grounded resistor through which the enhanced electron flow from the multiplier flows to generate a detectable potential. Surface 40 has a voltage $-(2n+3)V$ and surface 42 with a voltage $-(2n+2)V$. Grid 41 receives the same voltage as surface 40. The charge current flow through the dynode is directed on a path which first strikes surface 40, then passes, by virtue of the electrostatic field created in the multiplier to surface 42, thence to the surface 20 of the first dynode 16 in row 12, thence to the surface 30 of the first dynode 26 in row 14 and thence back and forth, in analogous manner to successive ones of dynodes in alternate rows 12, 14 until the last dynode 16 of row 12 is reached, charge current then passing to collector 46. Secondary electrons generated where the charge path strikes the surface 42, 20, 30 operate to multiply the incoming charge current applied at the input end 10*a*, as collected at collector 46, in a manner known per se. In particular, the dynodes 16, 26 of each row 12, 14 are spaced apart equal pitch distances and dynodes in one row are positioned one half pitch distance out of phase with those of the other row, as reckoned in the direction of axis 28**.

Figure 5:
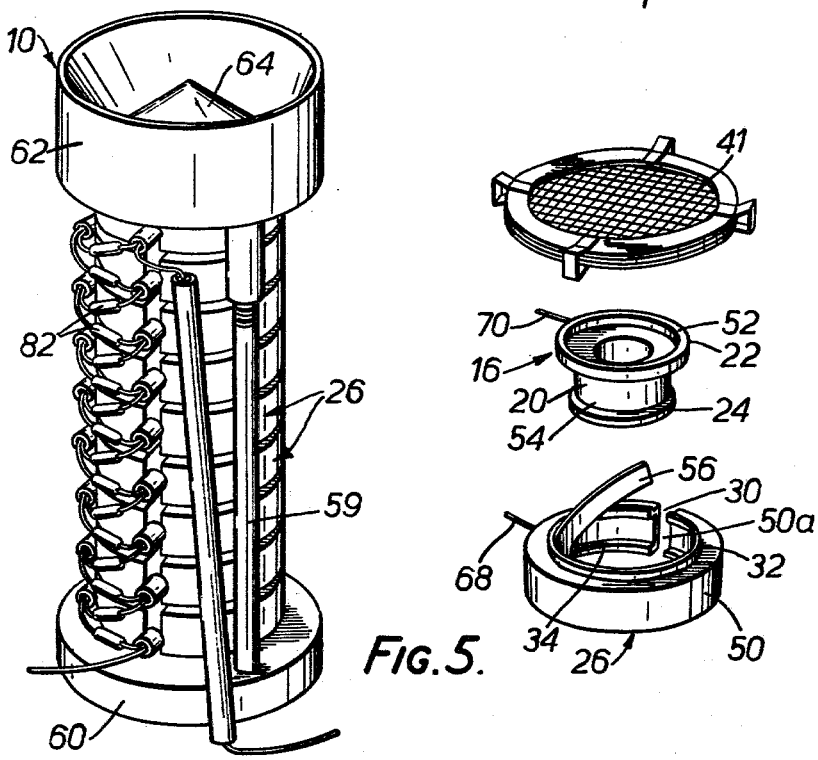
FIG. 5 is a perspective view of a completely assembled electron multiplier constructed in accordance with the invention, together with certain component parts thereof.

FIG. 5 shows a typical mechanical construction for multiplier 10. Here, the dynodes 16 are of two-part form each comprising a stainless steel annular ring 52 provided with the flanges 22, 24, with the surface 20 being provided on a strip of beryllium-copper material which is flexible and which is removably secured around the periphery of the ring 52 between the flanges 22, 24. Securement may be effected by small welds which are sufficient to hold the strip 54 in place, but which can be readily broken to remove the strip 54 if desired. In a like manner, the dynodes 26 are of two-part construction comprising a stainless steel annular ring 50 with the flanges 32, 34 formed thereon and with the surface 30 being defined on a flexible strip 56 of beryllium-copper material which is accommodated within the ring on the inner surface thereof between the flanges 32, 34. The collector surface 46 is formed on a disc-shaped stainless steel end piece 60 whilst the surface 42 is formed in like manner to surfaces 20, 30 on a beryllium-copper strip (not shown) secured to a stainless steel annular opposite end piece 62.

The rings 50 are positioned in coaxial relation one above the other, being separated by suitable insulation such as ruby balls 58 (FIG. 1). Insulated tie rods 59 are provided extending between end pieces 60, 62 which end pieces are provided at top and bottom of the stack of rings 50 and, by tightening of threaded connections between the tie rods and one or more of the end pieces, the rings are securely clamped together. In a like manner, insulated tie rods 61 (FIG. 4) are provided extending axially through a coaxial stack of the rings 52 within rings 50. Rods 61 interconnect end piece 60 and a stainless steel body 64 at the opposite end of the stack which body has surface 40 provided thereon. In a like manner, ruby bead insulating elements are provided, between body 64 and the adjacent dynode 16, between the individual dynodes 16, and between the output end dynode 16 and the end piece 60. Tightening of threaded interconnections between the tie rods 61 and one or more of the body 64 and end piece 60 ensure the right clamping of the dynodes in position.

Leads 68 for the dynodes 26 are provided, these being secured directly to the annular rings 50 and extending outwardly therefrom. Similarly leads 70 for the dynodes 16 are provided, these being secured to the annular rings 52 and extending radially outwardly thereof. The rings 50 are split to provide side openings **50*a* therein and leads 70 from dynodes 16 pass from these exteriorally of the multiplier. Resistors 82 interconnect respective successive ones of the dynodes 16, 26 and the collector 46 so that when an appropriate voltage is placed across the collector 46 and the last dynode 16 the appropriate voltages for operation of the multiplier are applied to the dynodes. Connections may, likewise, be made to the surfaces 40, 42 and to the grid 40**.

An experimental multiplier 10 formed in accordance with the invention had the following dimensions:

| | | | | |
|---|---|---|---|---|
| for a | = | $r_i$ | = | 5 mm |
| $a'$ | = | $0.3\ a$ | = | 1.5 mm |
| $b_i$ | = | $0.15\ r_i$ | = | 0.8 mm |
| $b_o$ | = | $0.15\ r_o$ | = | 1.6 mm |
| $b_i'$ | = | $0.5\ b_i$ | = | 0.4 mm |
| $b_o'$ | = | $0.5\ b_o$ | = | 0.8 mm |
| $r_o$ | = | $r_i + 1.2a$ | = | 11 mm |

In this arrangement the free margins of the flange portions **32*b*, 22*b*, were positioned to extend towards the input end 10A such that each projected some 0.5 mm over the respective flange 34, 24** of the preceding dynode, in its row, but this spacing is not critical.

The described construction has been found to be particularly advantageous in use. The manner of formation of the dynodes, involving use of the annular rings 50, 52 and the removable strips 54, 56 is particularly advantageous since when the surfaces 20, 30 lose effectiveness, they can be simply replaced by removing the strips 54, 56 and providing new ones. The strip 56, if it is resilient material can be particularly easily maintained in position simply by natural resilience against the inner surface of the ring 50. Whilst breaking of the small welds adhering the strip 54 to ring 52 is necessary, this, in practice, is not difficult.

Whilst the described arrangement utilizes surfaces 20, 30 of circular form when viewed in transverse section, this is not absolutely essential since the surfaces could be of other form such as polygonal with a large number of small segmented surface portions.

In the described construction, the secondary emission surfaces are provided on removable strips 54, 56 although they could be formed as removable deposits on the rings 50, 52 for example, they could be formed by evaporation sputtering, plasma spraying, electro plating, or other chemically reactive gaseous or liquid processes, such as electro deposition, or electrolytic processes such as electro plating followed by caesiation or other treatment to render the surface a high yielding secondary electron emitting surface.

The described arrangement has been advanced merely by way of explanation and many modifications may be made thereto without departing from the spirit and scope of the invention as defined in the appended claims.

We claim:

1. An electron multiplier of the kind in which, in use of the multiplier, a charge current is amplified by passage to, and by secondary emission of electrons from, surfaces of successive dynodes of a dynode array, there being two generally parallel rows of said dynodes, the dynodes in each row being in side-by-side position, said successive dynodes being dynodes in alternate ones of said rows and succeeding adjacent ones of the dynodes in each row receiving said charge current in use of the multiplier; said dynodes being shaped such that electric potentials which are in use applied to the dynodes generate an electric field between the two rows such as to effect substantial direction of secondary electrons produced at said surface to the surface of the next successive dynode, wherein the surfaces of dynodes in one said row are substantially cylindrical in configuration on a common axis, dynodes of the one row being spaced along said axis, the surfaces of dynodes of the other said row also being substantially cylindrical in form and coaxial with surfaces of dynodes of the first row, the said surfaces of the dynodes of the other said row being of greater diameter than those of dynodes of the first row and dynodes of the said other row being spaced lengthwise along the said axis, the surfaces of dynodes of said one row facing away from said axis and the surfaces of dynodes of the other row facing towards said axis in opposed relationship to the surfaces of dynodes of said one row; said surface of each dynode being linear and parallel to said axis when viewed in axial section, with first and second flanges positioned along edges of the surface at opposite axial ends thereof, said first flange extending substantially normally to the surface from one said opposite edge and said second flange having a first portion extending substantially normally to the surface from the other opposed edge in the same direction as said one flange and a second portion extending from an outer longitudinal edge of the first portion parallel to said surface and directed in the direction away from the first flange.

2. An electron multiplier as claimed in claim 1 wherein said second portion of each said second flange is positioned further from said surface than the free edge of the first flange.

3. An electron multiplier as claimed in claim 2 wherein the proportions of the dynodes are substantially as follows, where a is the distance between flanges of a said dynode, a' is the width (measured in the axial direction of the multiplier) of said second portion of said second flange of a said dynode, $b'_i$ and $b'_o$ are the heights above said surfaces of said first flanges of dynodes of said one row and of said other row respectively, $b_i$ and $b_o$ are the heights above said surfaces of said first portions of said second flanges of dynodes of said one row and of said other row respectively, and $r_i$ and $r_o$ are the radii of said surfaces of dynodes of said one row and of said other row respectively, for a defined within the range $r_i \leqq a \leqq 2r_i$

| | | | | | |
|---|---|---|---|---|---|
| $a'$ | = | $0.3\ a$ | | | |
| $b_i$ | = | $0.15\ r_i$ | $b_o$ | = | $0.15\ r_o$ |
| $b_i'$ | = | $0.5\ b_i$ | $b_o'$ | = | $0.5\ b_o$ |
| $r_o$ | = | $r_i + 1.2\ a$ | | | |

4. An electron multiplier as claimed in claim 2 or claim 3 wherein each said dynode includes a body part defining the said flanges and a cylindrical portion to which a sensitive surface material is applied to form the said surface of that dynode.

5. An electron multiplier as claimed in claim 4 wherein said surface is formed by deposition on to said portion.

6. An electron multiplier as claimed in claim 2 or claim 3 wherein said surface of each said dynode is defined on a removable flexible strip, secured to a body defining the said first and second flanges of a cylindrical element.

7. A dynode array for an electron multiplier of the kind in which, in use of the multiplier, a charge current is amplified by passage to, and by secondary emission of electrons from, surfaces of successive dynodes of a dynode array, there being two generally parallel rows of said dynodes, the dynodes in each row being in side-by-side position, said successive dynodes being dynodes in alternate ones of said rows and succeeding adjacent ones of the dynodes in each row receiving said charge current in use of the multiplier; said dynodes being shaped such that electric potentials which are in use applied to the dynodes generate an electric field between the two rows such as to effect substantial direction of secondary electrons produced at said surface to the surface of the next successive dynode; said dynode array comprising two said rows each of at least two said dynodes, dynodes in one row having said surfaces thereof in opposed facing disposition relative to said surfaces of dynodes of the other row, the said surface of each said dynode in each said row, which surface is adjacent an edge of a surface of an adjacent succeeding said dynode, being bounded by a first flange extending normally of the surface and towards the other row, and the said surface of each respective succeeding dynode in a row being bounded at an edge adjacent the said first flange of the respective adjacent preceding dynode in its row by a second flange having a first portion extending normally of said surface towards the other row and parallel to but spaced from the first flange of the respective said preceding dynode and a second portion extending outwardly from a lengthwise free edge of the first portion, which free edge is closest the other row and parallel to the said surface of its dynode, and over and spaced from the free edge of the first flange of the respective preceding dynode; wherein said surfaces of dynodes in said one row are substantially cylindrical in configuration, with axes aligned on a common axis, said surfaces of dynodes of said other row also being substantially cylindrical in form with axes coaxial with said common axis, the surfaces of dynodes of the other row being of greater diameter than those of dynodes of said one row, said surfaces of dynodes of both said rows being linear and parallel to said axis, when viewed in axial section.

8. A dynode array as claimed in claim 7 wherein the second portion of each said second flange extends to overlie in spaced disposition a marginal part of the said surface of the respective preceding dynode, which marginal part is adjacent to and extends lengthwise of said first flange of the respective preceding dynode.

9. A dynode array as claimed in claim 8 wherein overlap of each said second portion over the surface of the respective preceding dynode is by an amount of approximately 25% of the width of such second portion.

10. A dynode array as claimed in claim 8 wherein the second portion of each second flange extends only to a location substantially directly above the first flange of the respective preceding dynode.

11. A dynode array as claimed in claim 10 wherein dynodes in each said row are spaced apart a constant pitch, but dynodes in one row are shifted by a distance equal to half of the pitch in the direction of extent thereof, relative to the other row.

12. A dynode array as claimed in claim 11 wherein the array includes additional deflecting surfaces arranged at input and output ends of the array to direct current in and out of the array.

13. A dynode array as claimed in claim 12 wherein said second portion of each said second flange is positioned further from said surface than the free edge of the first flange.

14. A dynode array as claimed in claim 13 wherein proportions of the dynodes are substantially as follows, where a is the distance between flanges of a said dynode, a′ is the width (measured in the axial direction of the multiplier) of said second portion of said second flange of a said dynode, $b'_i$ and $b'_o$ are the heights above said surfaces of said first flanges of dynodes of said one row and of said other row respectively, $b_i$ and $b_o$ are the heights above said surfaces of said first portions of said second flanges of dynodes of said one row and of said other row respectively, and $r_i$ and $r_o$ are the radii of said surfaces of dynodes of said one row and of said other row respectively.

for a defined within the range $r_i \leqq a \leqq 2r_i$

| | | | | | |
|---|---|---|---|---|---|
| $a'$ | = | 0.3a | | | |
| $b_i$ | = | 0.15 a | $b_o$ | = | 0.15 $r_o$ |
| $b_i'$ | = | 0.5 $b_i$ | $b_o'$ | = | 0.5 $b_o$ |
| $r_o$ | = | $r_i$ + 1.2 a | | | |

15. A dynode array as claimed in claim 13 or claim 14 wherein said surfaces of dynodes of the said one row are removable secondary emission surfaces on structure defining the remainder of these dynodes.

16. A dynode array as claimed in claim 15 wherein said structure comprises a series of cylindrical elements, each defining the flanges of a separate said dynode of said one row to opposed edges thereof, with the secondary emission surfaces each extending around the curved periphery of a said cylindrical element between the said flanges of that element.

17. A dynode array as claimed in claim 16 wherein the surfaces of dynodes of said other row are removable secondary emission surfaces on supporting structure defining the remainder of the dynodes.

18. A dynode array as claimed in claim 17 wherein the last mentioned structure comprises a series of annular elements each such annular element carrying the said flanges of a respective said dynode of the other row, at opposed edges thereof, and said secondary emission surfaces of the other row being on respective inside surfaces of the annular elements between the said flanges thereof.

19. A dynode array as claimed in claim 18 wherein the secondary emission surfaces are formed on secondary emission elements removably secured to the said inside surfaces of the said annular elements and to the curved peripheries of the said cylindrical elements.

20. A dynode array as claimed in claim 18 wherein said secondary emission surfaces are formed as removable deposits on the said cylindrical and annular elements.

21. A dynode array as claimed in claim 19 wherein said cylindrical elements of said one row are formed of conductive material and mechanically secured together, but electrically insulated from each other.

22. A dynode array as claimed in claim 21 wherein the said annular elements of said other row are formed of conductive material and are mechanically secured together but electrically insulated from each other.

23. An electron multiplier comprising an array as claimed in claim 8 with the said second portions of said second flanges directed, from said first portions, in the direction towards the input end of the multiplier, means being provided for applying electric potentials across each successive pair of electrodes to generate the said field.

24. An electron multiplier as claimed in claim 23, including grid means for acceleration of charged particles towards the first dynode thereof, whereby the multiplier may be used for detecting output current from a mass spectrometer.

* * * * *